US009701153B2

(12) United States Patent
Chiao et al.

(10) Patent No.: US 9,701,153 B2
(45) Date of Patent: Jul. 11, 2017

(54) HEAT TRANSFERS WITH MINIMAL TRANSFER MARKING ON PERFORMANCE FABRICS

(71) Applicant: Avery Dennison Corporation, Mentor, OH (US)

(72) Inventors: Yi-Hung Chiao, Temple City, CA (US); Liviu Dinescu, Hickory, NC (US); Andrew Spendlove, Kaupanger (GB); Johannes Yttri, Fortun (NO); Osman N. Tanrikulu, Denver, NC (US); Ben T. O'Brien, Greensboro, NC (US)

(73) Assignee: AVERY DENNISON RETAIL INFORMATION SERVICES, LLC, Westborough, MA (US)

( * ) Notice: Subject to any disclaimer, the term of this patent is extended or adjusted under 35 U.S.C. 154(b) by 0 days.

(21) Appl. No.: 14/583,928

(22) Filed: Dec. 29, 2014

(65) Prior Publication Data

US 2016/0009124 A1 Jan. 14, 2016

Related U.S. Application Data

(60) Provisional application No. 61/923,947, filed on Jan. 6, 2014.

(51) Int. Cl.
*B41M 1/26* (2006.01)
*B41M 5/44* (2006.01)
(Continued)

(52) U.S. Cl.
CPC ..... *B44C 1/172* (2013.01); *B41M 1/26* (2013.01); *B41M 5/41* (2013.01); *B41M 5/42* (2013.01); *B41M 5/44* (2013.01); *B44C 1/1756* (2013.01)

(58) Field of Classification Search
CPC .. B41M 1/26; B41M 5/42; B41M 5/44; B44C 1/17; B44C 1/172
(Continued)

(56) References Cited

U.S. PATENT DOCUMENTS 3,684,545 A 8/1972 Worrall
6,228,486 B1 5/2001 Kittel et al.
(Continued)

FOREIGN PATENT DOCUMENTS

GB 1393992 A 5/1975
WO 02098662 A1 12/2002

OTHER PUBLICATIONS

International Search Report and Written Opinion prepared for PCT/US2014/072473 dated Apr. 14, 2015.

*Primary Examiner* — Bruce H Hess
(74) *Attorney, Agent, or Firm* — Avery Dennison Retail Information Services, LLC

(57) ABSTRACT

Heat transfers are provided that have indicia for labeling or enhancing the appearance of performance fabric material, such as apparel including sportswear fabrics with elastomeric characteristics. The label assembly includes a support portion with a label carrier layer and a release coating, along with a transfer portion over the support portion release coating that includes an ink design and a hot melt adhesive layer. The hot melt adhesive layer securely transfers the ink design to the fabric at relatively low temperature and pressure conditions for a relatively low dwell time.

26 Claims, 3 Drawing Sheets

(51) Int. Cl.

| | |
|---|---|
| ***B44C 1/17*** | (2006.01) |
| ***B44C 1/175*** | (2006.01) |
| ***B41M 5/41*** | (2006.01) |
| ***B41M 5/42*** | (2006.01) |

(58) Field of Classification Search
USPC ..... 428/32.79, 32.81
See application file for complete search history.

(56) References Cited

U.S. PATENT DOCUMENTS

| | | | | |
|---|---|---|---|---|
| 7,906,189 | B2 | 3/2011 | Tsai et al. | |
| 8,349,427 | B2 | 1/2013 | Grotefend | |
| 8,834,974 | B1 * | 9/2014 | Ferry | B41M 1/32 156/240 |

* cited by examiner

HEAT TRANSFERS WITH MINIMAL TRANSFER MARKING ON PERFORMANCE FABRICS

CROSS-REFERENCE TO RELATED APPLICATION(S)

The present application claims priority from U.S. Provisional Application No. 61/923,947 filed Jan. 6, 2014 which is incorporated by herein by reference in its entirety.

BACKGROUND

Field of the Disclosure

The present subject matter relates to heat transfers that feature anti-marking during transfer, particularly onto performance fabrics, particularly synthetic fabrics, textiles and garments, including sportswear fabrics, clothing and accessories. The present subject matter is especially suitable for transfers having an ink design layer protected by a support sheet suitable for use in heat-transfer labeling and the like.

Description of Related Art

Transfer decoration, labels, patches, tags, identification placards, embellishments and the like are widely used for a variety of different applications including logos, trademarks, keyboard symbols, whether numeric, alphabetic or alphanumeric or other symbols, sports designs, logos and names, fabric and clothing design details, accents and backgrounds, artwork of various shapes and the like. At times these are referred to herein as designs, images and/or indicia. In some applications, these decorative components are in the nature of heat transfers, often referred to as labels, suitable for application on fabrics, clothing and accessories that are of the performance fabric variety exhibiting a relatively high degree of susceptibility to damage upon being subjected to heat transfer application. Such performance fabrics, clothing and accessories to be enhanced with heat transfer decorative components often concern so-called "soft goods," a term generally understood in the art. Examples include clothing, upper bodywear, lower bodywear, headwear, footwear, outerwear, underwear, garments, sportswear fabrics, other sheet goods, banners, flags, athletic or sport clothing, uniforms, and combinations thereof.

Performance fabrics for soft goods or the like can include those exhibiting stretchability, soft touch tactile characteristics, and vivid color appearance, while being flexible in process manufacturing. Typical synthetic fibers suitable for inclusion in the performance fabric category include polyesters, polyamides, nylons, and combinations of such materials with cotton and/or stretchable or resilient materials such as spandex or elastane or Lycra® and the like. Performance fabrics are a particular challenge for heat transfers, being susceptible to damage during ink design enhancement and unwanted "ghost" marking formation during the heat transfer process.

Thermal transfer laminates for heat transfer labels and procedures are generally known. Examples include the following. U.S. Pat. No. 7,906,189 concerns heat transfer labeling for fabric incorporating a release coating for addressing problems encountered when trying to effect a cleaner release of the label from the fabric, often in the context of cooling time shortening. U.S. Pat. No. 6,228,486 concerns heat transfer laminates for ink or graphics layers adhered to the release coating. U.S. Pat. No. 8,349,427 concerns heat transfer labels that can incorporate an adhesive layer, a solvent-borne ink and includes a dye migration resistant property. These do not address and solve the problem of achieving secure heat transfer of ink designs, images and/or indicia on performance fabrics while minimizing or eliminating undesirable markings during the heat transfer procedure by heat transfer bonder equipment.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

Heat transfer labeling of textile and garment fabrics typically is conducted under high heat, high pressure and long dwell time, which has been found to at times lead to various burn marks, pressure marks, bonder marks, die marks, release marks, transfer marks and the like on the fabric surface. In embodiments, the present disclosure provides a unique heat transfer label design and can combine effective chemistry features and, when desired, layer construction to address these issues, particularly for performance fabrics that can be especially susceptible to such performance issues. Layer construction can be modified with respect to release layer, printed ink and heat transfer components in solving problems associated with these types of products. For example, embodiments of this disclosure enable a very successful heat transfer of images to be carried out at lower pressure and temperature and for shorter dwell times than typically needed with previous heat transfer labels and methods, while achieving same with no or minimal visible transfer marking while maintaining high print quality, excellent wash resistance, soft-to-the touch characteristics and stretchability, all of which can be especially important for fabrics, textiles and garments that are recognized as being in the performance category.

In one aspect of this disclosure, a heat transferable label is provided that has a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design or indicia layer exhibiting recoverable stretch properties. The hot melt adhesive layer securely adheres the heat transfer label to the performance fabric under conditions of relatively low temperature and pressure and short heat transfer dwell time.

In another aspect, of this disclosure, a heat transferable label is provided that has a label carrier or support portion with a release coating, as well as a transfer portion positioned over the label carrier release coating for transfer of the transfer portion from the label carrier to a performance fabric under conditions of heat and pressure for a given dwell time. The release coating is sized and shaped in substantial conformance with the size and shape of an image delineated by the ink design layer, for addressing ghost image generation by the release coating upon heat transfer application. The transfer portion comprises a hot melt adhesive layer with first surface for fabric contact and a second surface with an ink design layer printed onto it, the ink design layer exhibiting recoverable stretch properties. The hot melt adhesive layer securely adheres the heat transfer label to the performance fabric under conditions of relatively low temperature and pressure and short heat transfer dwell time.

In further aspect of this disclosure, a heat transferable label is provided that has a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design layer exhibiting recoverable stretch properties. The release coating is sized and shaped in substantial conformance with the size and shape of an image delineated by the ink design layer and by the hot melt adhesive layer, for addressing ghost image generation by the release coating upon heat transfer application. The hot melt adhesive layer securely adheres the heat transfer label to the performance fabric under conditions of relatively low temperature and pressure and short heat transfer dwell time.

In an added aspect of this disclosure, a heat transferable label is provided that has a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design layer exhibiting recoverable stretch properties. The hot melt adhesive layer securely adheres the heat transfer label to the performance fabric under conditions of relatively low temperature and pressure and short heat transfer dwell time. The hot melt adhesive layer is a thermoplastic polyester polymer hot melt adhesive powder with elastomeric dispersion, combined with a thermoplastic polyurethane hot melt adhesive powder.

In a further aspect, the disclosure relates to a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design layer exhibiting recoverable stretch properties. The hot melt adhesive layer securely adheres the heat transfer label to the performance fabric under conditions of relatively low temperature and pressure and short heat transfer dwell time. The hot melt adhesive layer is a thermoplastic polyester polymer hot melt adhesive powder with elastomeric dispersion, combined with a thermoplastic polyurethane hot melt adhesive powder and a resin that is a solid plasticizer tackifier.

In an additional aspect, the disclosure relates to a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design layer exhibiting recoverable stretch properties. The hot melt adhesive layer securely adheres the heat transfer label to the performance fabric under conditions of relatively low temperature and pressure and short heat transfer dwell time. The hot melt adhesive layer is a thermoplastic polyurethane polymer hot melt adhesive powder with elastomeric dispersion, combined with a polyamide hot melt adhesive powder and a resin that is a solid plasticizer tackifier.

In another aspect, the disclosure relates to a label carrier or support portion with a release coating, as well as a transfer portion positioned over the label carrier release coating for transfer of the transfer portion from the label carrier to a performance fabric under conditions of heat and pressure for a given dwell time. The transfer portion comprises a hot melt adhesive layer with first surface for fabric contact and a second surface with an ink design layer printed onto it, the ink design layer exhibiting recoverable stretch properties. The hot melt adhesive layer securely adheres the heat transfer label to the performance fabric under conditions of relatively low temperature and pressure and short heat transfer dwell time. The hot melt adhesive layer is a thermoplastic polyurethane polymer hot melt adhesive powder, combined with a resin that is a solid plasticizer tackifier.

DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
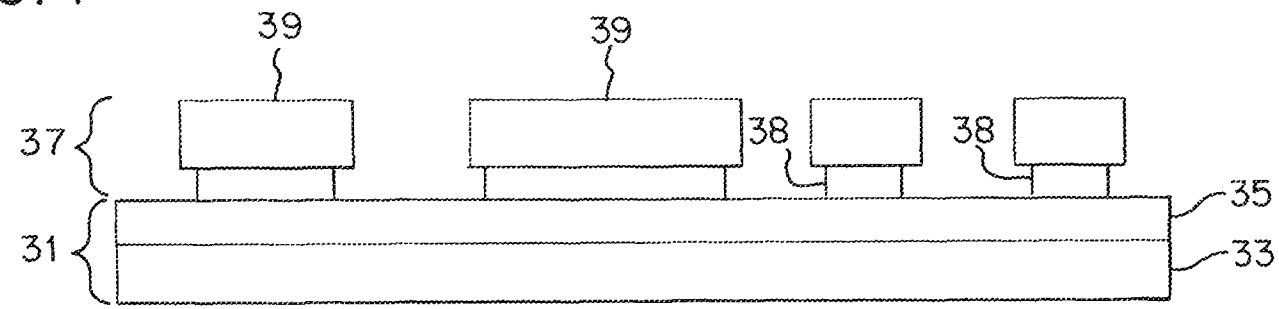
FIG. 1 is a schematic illustration showing multiple layers of a first embodiment according to the present disclosure.

FIG. 1 is a schematic representation of a heat transfer label construction and illustrates a first embodiment that achieves secure and substantially permanent transfer of a desired image, design and/or indicia to a performance fabric under less rigorous heat transfer conditions when compared with other heat transfer label constructions not according to the present disclosure. These less rigorous heat transfer conditions include one or more of lower temperature than such other constructions, lower pressure than such other constructions, and shorter dwell time within the heat transfer equipment than required for such other constructions. In the most advantageous arrangements, all of lower temperature, lower pressure and shorter dwell time are followed without detrimentally affecting transfer effectiveness. Each less rigorous heat transfer condition has been found to eliminate or substantially minimize visible transfer marking and to maintain high print quality of the performance fabric subjected to the heat transfer. The resultant performance fabric, textile or garment has been found to exhibit wash resistance, soft touch properties and stretchability.

A support portion, generally designated at 31, is shown in the FIG. 1 heat transfer embodiment to include a label carrier 33 and a release layer or coating 35 that takes the form of a non-transfer release, discussed in more detail herein below. The support portion 31 typically is provided which has the function of a label carrier that provides mechanical strength to the label assembly allowing handling such as being wound up in a roll for storage, stacking, and as a label feed for mechanized operations. Basically, the support portion is a sheet carrier and a release layer. Typical label carrier sheets are cellulosic or polymeric film, such as polyethylene terephthalate (PET). A typical release layer or coating 35 is a low melting temperature, thinly coated film on the sheet carrier that facilitates peeling of the transfer portion from the sheet carrier when the heat transfer is completed. An example of a support portion 31 is an "O6" liner which is thermally stabilized polyethylene terephthalate (PET) of about 5 mil thickness coated with an amide wax-based heat-induced release layer 35, commercialized by Avery Dennison (RBIS Division). Other release layers 35 include extruded polypropylene (such as same commercially available from Felix Schoeller), 3.04, 4.14, and HD release print and coatings of Avery Dennison, TGR and CGR (C-matte) polyester-based compositions from Hanse Corporation, and S-4 and S-6 release coated PET from ADC.

A first surface of the non-transfer release 35 is on the label carrier 33, while the opposite, second surface has positioned thereon a transfer portion, generally designated at 37. The transfer portion provides the heat transferred design, image and/or indicia elements that are made from the transfer or label of this embodiment and that transfer to the fabric. Included in the transfer portion of this illustrated heat transfer is a printed ink design layer 38 and a heat transfer adhesive layer or component 39. The materials of these components, especially of the heat transfer adhesive layer, are important in achieving heat transfer of the design elements onto the fabric under reduced temperature, pressure and dwell time conditions, minimizing risk of damage to the fabric and/or the design during the heat transfer process.

With further reference to the non-transfer release aspects of this embodiment, the non-transfer release 35 is of a size and footprint that substantially conforms to the size and footprint of the label carrier 33. It will be understood that, in this context, "footprint" can designate the overall shape outlined by the perimeter of the component referenced, or its covering area. With this approach, only the transfer portion 37 (including the printed ink layer 38 in the configuration of the image to be transferred and the heat transfer adhesive layer 39) transfers to the fabric by the heat transfer action. The non-transfer release layer 35 does not transfer.

Figure 2:
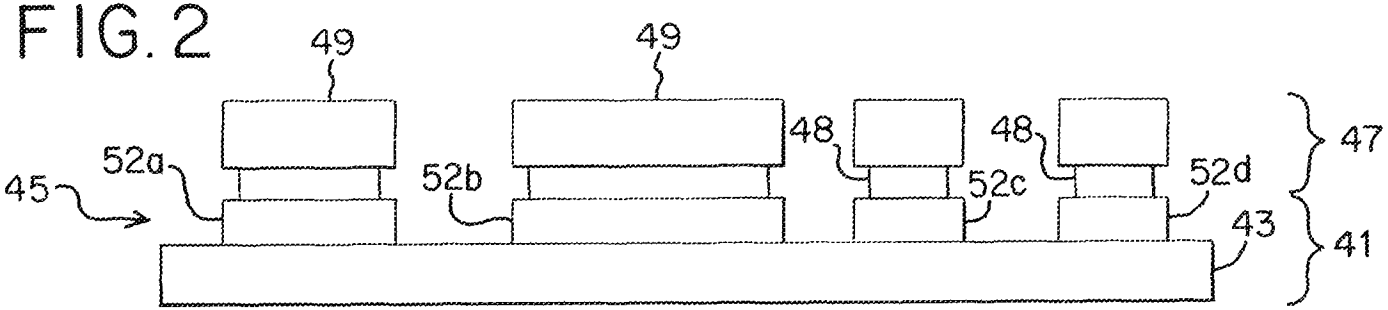
FIG. 2 is a schematic illustration showing multiple layers of a second embodiment according to the present disclosure.

FIG. 2 is a schematic representation of another heat transfer label construction and illustrates a second embodiment that also achieves secure and substantially permanent transfer of a desired image, design and/or indicia to a performance fabric under less rigorous heat transfer conditions when compared with other heat transfer label constructions not according to the present disclosure. This embodiment also adds a feature that further minimizes the chance of "ghost" images appearing on the fabric caused by the heat transfer operation. Typically such ghost images outline the design and/or indicia that have been heat transferred and appearing as undesirable markings on the fabric at locations close to all or part of the design and/or indicia image.

A support portion, generally designated at 31, is shown in the FIG. 1 heat transfer embodiment to include a label carrier 33 and a release layer or coating 35 that takes the form of a non-transfer release, discussed in more detail herein below. A first surface of the non-transfer release 35 is on the label carrier 33, while the opposite, second surface has positioned thereon a transfer portion, generally designated at 37. The transfer portion provides the design, image and/or indicia elements of the heat transfer from the transfer or label of this embodiment to the fabric. Included in the transfer portion of this illustrated heat transfer is a printed ink design layer 38 and a heat transfer adhesive 39. The materials of these components, especially of the heat transfer adhesive layer, are important in achieving heat transfer of the design elements onto the fabric under reduced temperature, pressure and dwell time conditions, minimizing risk of damage to the fabric and/or the design during the heat transfer process.

A support portion, generally designated at 41, is shown in the FIG. 2 heat transfer embodiment to include a label carrier 43 and a release layer or coating that takes the form of a shaped release, discussed in more detail herein below. A first surface of the shaped release, generally designated at 45, is on the label carrier 43, while the opposite, second surface has positioned thereon a transfer portion, generally designated at 47. The transfer portion provides the design elements that transfer from the heat transfer or label of this embodiment to the fabric. Included in the transfer portion of this illustrated heat transfer is a printed ink design layer 48 and a heat transfer adhesive layer 49. Each such layer is illustrated to be in a plurality of design components that can be considered to follow the design, image and/or indicia to be transferred onto the fabric, including performance fabric. For example, each such component could take the form of a keyboard symbol such as a letter of the alphabet that together form an indicia message from this plurality of design components that are arranged in a desired series or relationship according to the intent of the designer. The materials of these components, especially of the heat transfer adhesive layer, are important in achieving heat transfer of the design elements onto the fabric under reduced temperature, pressure and dwell time conditions, minimizing risk of damage to the fabric and/or the design during the heat transfer process.

Concerning the shaped release 45 illustrated in FIG. 2, this is in the form of one or more sections 52*a*, 52*b*, 52*c*, 52*d* and so forth as needed for transferring a particular design, image and/or indicia of the heat transfer product or label. Unlike the non-transfer release layer 35, each shaped release section or sections is of a size and footprint that substantially conforms to the size and footprint of each respective section of the design that is created by the printed ink layer, as generally illustrated in FIG. 2. While the shaped release section or sections 52*a*, 52*b*, 52*c*, 52*d* and so forth are on the label carrier 43 in the heat transfer assembly before it is subjected to the heat transfer to the fabric, each shaped release section can transfer with the printed ink design layer 48. Typically, each shaped release section or sections 52*a*, 52*b*, 52*c*, 52*d* and so forth has a size and footprint that substantially conforms to the heat transfer adhesive layer 49. When desired, the size of the printed ink layer footprint or footprints can be slightly less than the respective footprint or footprints of the heat transfer adhesive layer and or of the shaped release layer. Thus, either or both of the individual components of heat transfer adhesive layer and the shaped release layer can have an area size and shape that is the same as, or slightly in excess of, the printed ink layer area or areas, so that the adhesive and/or shaped release layers are respectively coincident in size and shape or slightly overlapped by the size and shape of the second barrier layer 42. When present, the width of such overhang can be no greater than about 0.5 mm, or 0.3 mm, or 0.2 mm.

With the approach of FIG. 2, the likelihood of any ghost images forming upon heat transfer are significantly minimized. In effect, the tightly shaped release layer components remove, such as by cutting of a transfer release sheet, portions of the release layer that might otherwise cause or contribute to ghost image formation. This important advantage is enhanced by combining this shaped release layer structure with the chemistry of the materials of the heat transfer, particularly of the heat transfer adhesive that has been found to perform very well from an adherence perspective even under less rigorous heat application conditions and even when using lower grades of heat transfer application equipment, the combination reducing instances of undesirable marking on fabrics, including comparatively sensitive performance fabrics.

Referring to materials for the transfer portion or portions 37, 47 of the heat transfer label, the printed ink design layer 38, 48 can take the form of screen-printed pigmented ink or dye ink with recoverable stretch properties. Same can include an elastic polyurethane ink with white pigment, which can be without a cross-linker. Such an ink can be made from polyurethane dispersion that has high elongation properties (such as greater than 300%). Examples include Hauthane L-2969, SANCURE® 20041 of Lubrizol, and UROTUF® L522 of Reichold, Inc. Typically these are combined with titanium dioxide pigments, such as Ti-Pure® R-960 from DuPont, TIONA® 595 of Crystal Pigment Ltd. and Tint-Ayd® HC 6003 of Elements Specialties. Also suitable are Avery Dennison's screen print AQ-white ink mixed with one of these high elongation polyurethane dispersions, or Icoflex Performance Opaque White ink. Elastomeric emulsions for including in the printed ink design layer include HYSTRETCH® V-29, a polyurethane-based white ink cross-linked with aziridine (P-2 ink) from Lubrizol Advanced Materials.

The heat transfer layer portion or portions 39, 49 of the transfer portion or portions 37, 47 include hot melt adhesives or compositions. They can be applied by pattern printing or by powdering. Included are resin-modified hot melt adhesives with enhanced melt flow and fabric bonding under reduced temperature, pressure and dwell time settings during heat transfer by equipment such as an INSTA® 718 bonder from Insta Graphic and a CSB-7 bonder from Avery Dennison and a CF-2003 heat transfer machine from Cheran.

Suitable hot melt adhesive components include a thermoplastic polymer powder with elastomeric polymer dispersion along with solid tackifier. Examples of thermoplastic polymers are polyesters, polyamides, polyurethanes and polyacrylates. Examples are polyester or copolyester hot melt adhesives, including polyester polymer powder such as GRILTEX® D 2132E from EMS-Griltech. Such can be combined with elastomeric polyurethane dispersion such as a polyester-based polyurethane dispersion, for example EDOLAN® GS of Tanatex Chemicals. Polyamides include GRILTEX® D 2133A polyamide or copolyamide. Polyurethanes include Schaetti Fix 6120 polyurethane from Schaetti A.G and EDOLAN® GS polyurethane of Tanatex Chemicals, polyurethane powders such as Unex 4078 of Dakota Nev., and aqueous polyurethane dispersions such as DISPERCOLL U42 of Bayer Aktiengesellschaft. Polyacrylates include Joncryl® 2561 polyacrylate from BASF, an acrylic latex resin.

Also often included in the hot melt adhesive or composition of the heat transfer layer portion or portions 39, 49 can be a solid plasticizer, a tackifier resin, or combinations thereof, (at times referred to herein as "Resin"). Examples of a suitable solid plasticizers are in the toluene sulfonamide family, such as toluene sulfonamide based reactive plasticizer KETJENFLEX® 9S from Axcentive Sarl, and o,p-toluene sulfonamide blends, including Uniplex 171 from Unitex Chemical Corporation. Other plasticizers include metallic stearates such as zinc stearate, acrylonitrile-butadiene copolymers, and fatty acid esters. Examples of suitable tackifier resins are useful for use in water-based adhesives, such as stabilized rosin ester emulsions having particles of microscopic sizing, including Super Ester E-720W from Arakawa Chemical Industries. When included, the plasticizer/tackifier resin enhances bonding strength especially for "L" (low) and "M" (medium) heat transfer bonding conditions described elsewhere herein. The "Resin" enhances bond strength and broadens the bonding condition range of the heat transfer adhesive layer in the transfer portion of the heat transfer assembly.

The layer of hot melt adhesive or composition can be formed by combining a thermoplastic polymer with a melt flow/hot tack enhancing resin. Examples include formulations such as the following: (a) a thermoplastic polyurethane hot melt adhesive, such as a powder and/or dispersion, combined with a polyamide hot melt adhesive and with a solid plasticizer and tackifier resin; (b) a thermoplastic polyurethane hot melt adhesive, such as a powder and/or dispersion, combined with a solid plasticizer and tackifier resin; (c) a thermoplastic polyurethane hot melt adhesive, such as a powder and/or dispersion, combined with a polyamide hot melt adhesive; (d) thermoplastic polyester polymer hot melt adhesive powder (which can be combined with an elastomeric dispersion), combined with a thermoplastic polyurethane hot melt adhesive, such as a powder and/or dispersion, and with a solid plasticizer and tackifier resin; (e) a thermoplastic polyurethane hot melt adhesive, such as a power and/or dispersion, combined with a polyamide hot melt adhesive; and (f) combinations thereof.

Formulation (a) can include between about 50 and about 150 parts (or between about 80 and about 120 parts) polyamide, between about 10 and about 50 parts (or between about 15 and about 40 parts) polyurethane, and between about 5 and about 20 parts (or between about 8 and about 15 parts) solid plasticizer and tackifier resin, based on parts by weight of solids.

Formulation (b) can include between about 50 and about 150 parts (or between about 80 and about 120 parts) polyurethane, and between about 10 and about 50 parts (or between about. 15 and about 45 parts) solid plasticizer and tackifier resin, based on parts by weight of solids.

Formulation (c) can include between about 50 and about 150 parts (or between about 80 and about 120 parts) polyurethane, and between about 10 and about 50 parts (or between about 15 and about 40 parts) polyamide, based on parts by weight of solids.

Formulation (d) can include between about 50 and about 150 parts (or between about 80 and about 120 parts) polyester, between about 15 and about 110 parts (or between about 20 and about 100 parts) polyurethane, and between about 5 and 20 parts (or between about 8 and about 15 parts) solid plasticizer and tackifier resin, based on parts by weight of solids.

Formulation (e) can include between about 50 and about 150 parts (or between about 80 and about 120 parts) polyurethane and between about 10 and about 50 parts (or between about 15 and about 40 parts) polyester, based on parts by weight of solids.

For typical heat transfer bonder equipment, the present disclosure allows settings lower than typically used. Such typical bonders include the INSTA® 718 bonder of Insta Graphic, the AVERY® CSB-7 bonder of Avery Dennison, and the CF-2003 Heat Transfer Machine of Cheran. In this context, relative low bonding temperatures are less than about 140° C., or less than about 130° C. or less than about 120° C., relatively low bonding pressures are less than about 1 Bar, or less than about 0.8 Bar, or less than about 0.6 Bar, or not greater than about 0.5 Bar, or not greater than about 0.4 Bar, or not greater than about 0.3 Bar, and relatively short bonding times are less than about 15 seconds, less than about 12 seconds, less than about 10 seconds, less than about 8 seconds, or not greater than about 6 seconds.

Release force measurements were made to evaluate the release force between printed ink layers and backing layers or label carriers (PET or paper) having various release layers or coatings in engagement with the printed ink layer, measuring release force by the T-peel test at room temperature and at a peel rate of 12 inches per minute. The printed ink layers were a screen printed pigmented white ink with recoverable stretch properties combined with titanium dioxide pigments and exhibiting a high elongation of at least 300%. The ink layer was sandwiched between two release layers, one on either surface of the ink layer. The test results data are reported in Table A below:

TABLE A

| | | Release from PU white ink | |
|---|---|---|---|
| Release Type | Backing | Max Load (N/in) | Avg Load (N/in) |
| 3.04 | PET | 0.163 | 0.111 |
| O6 | PET | 0.606 | 0.349 |
| PP | Paper | 0.154 | 0.080 |
| TGR | PET | 0.162 | 0.035 |
| 4.14 | PET | 0.161 | 0.078 |
| HD | PET | 0.185 | 0.151 |
| S-4 | PET | 0.165 | 0.139 |
| S-6 | PET | 0.166 | 0.082 |
| CGR (C-matte) | PET | 0.164 | 0.085 |

The identity of the "Release Type" of the release layer of these data are specified hereinabove. The heat bonding conditions for this testing were at 266° F. (130° C.), for 12 seconds at 30 psi on the pressure dial of an Insta 718 Bonder of Insta Graphic, 15 inch by 15 inch platen. It was generally observed that the release force (average) was best when between 0.15 and 2.0 N/in to enable easy peeling of the carrier after application under heat transfer conditions indicated on textile surfaces while maintaining enough anchoring on the carrier to maintain the assembly before heat transfer. Surface tension of the release surface is preferably above 25 dynes/cm to ensure sufficient aqueous ink wetting out.

Release force measurements were made to evaluate the release force between heat transfer adhesive layers and PET backing layers or label carriers having two different release layers or coatings in engagement with the heat transfer adhesive layer, the adhesive layer being sandwiched between two release layers, one on either surface of the adhesive layer. In a typical heat transfer label printing process, the adhesive layer is slightly wider than the ink design, typically resulting in direct contact of the adhesive to the release, making it important to take this release force into account. This release force was measured by the T-peel test at room temperature and at a peel rate of 12 inches per minute. The heat transfer adhesive layer was a composition of thermoplastic polyester polymer hot melt adhesive with elastomeric dispersion and solid plasticizer, tackifier resin. The test results data are reported in Table B below:

TABLE B

| | | Release from PES HMA | |
|---|---|---|---|
| Release Type | Backing | Max Load (N/in) | Avg Load (N/in) |
| TGR | PET | 0.356 | 0.268 |
| CGR (C-matte) | PET | 4.552 | 2.758 |

The identity of the Release Type of the release layer of these data are specified hereinabove, the TGR and CGR (C-matte) each being from Hanse. The heat bonding conditions for this testing were at 266° F. (130° C.), for 12 seconds at 30 psi on the pressure dial of an Insta 718 Bonder of Insta Graphic, 15 inch by 15 inch platen. It was generally observed that the release force (average) was best when between 0.15 and 2.0 N/in to enable easy peeling of the carrier after application under heat transfer conditions indicated on textile surfaces while maintaining enough anchoring on the carrier to maintain the assembly before heat transfer. Surface tension of the release surface is preferably above 25 dynes/cm to ensure sufficient aqueous ink wetting out.

Figure 3:
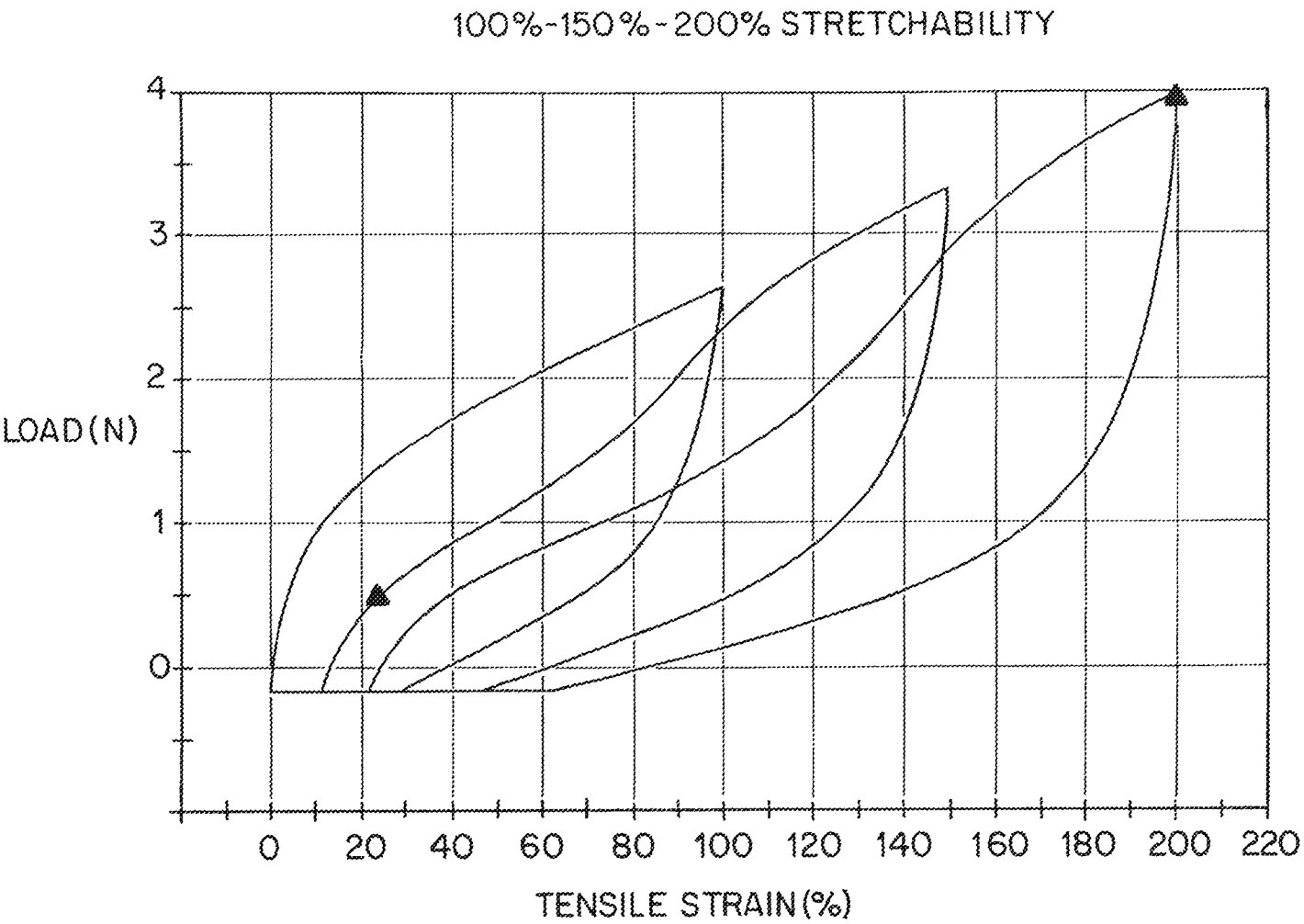
FIG. 3 is a plot of tensile strength versus load illustrating stretch property of a soft and stretchable printing ink at three different tensile strain extensions.

Testing was conducted to determine the stretch characteristics of printed ink layers, namely of an aqueous-based screen printing ink with elastomeric polyurethane or acrylic polymer combined with pigments/colorants and chemically cross-linked. Included was HyStretch® V-29 from Lubrizol Advanced Materials, a polyurethane based white ink cross-linked with aziridine. Instron® stretch testing was carried out on a 1 inch width by 1 inch gauge length ink film at 6 inches/min loading and unloading speed. The sample was stretched to three different extensions, namely 100%, 150% and 200%. The plot of the resulting data of load (N) versus tensile strain (%) is shown in FIG. 3, from which it is evident this ink layer showed good stretch recovery for all three levels of tensile strains.

EXAMPLE 1

Six heat transfer adhesive layers were formulated and tested for adhesive bond strength as a function of each of the compositions. The formulations are shown in Table C:

TABLE C

| | Parts by Weight of Solids | | | |
|---|---|---|---|---|
| Adhesive # | PES | PU | PA | Resin |
| PA.2 | 0 | 25 | 100 | 10 |
| PA.3 | 0 | 100 | 0 | 25 |
| PA.4 | 0 | 100 | 25 | 0 |
| PES.2 | 100 | 82.5 | 0 | 10 |
| PES.3 | 100 | 25 | 0 | 10 |
| PES.4 | 25 | 100 | 0 | 0 |

In Table C, PES designates polyester component, PU designates polyurethane component, PA designates polyamide component, and Resin designates a transfer enhancing agent, in particular a solid plasticizer, a solid tackifier or a combination component. The adhesive # designates the following heat transfer hot melt adhesive layers:

PA.2 ["formulation (a)"]—thermoplastic elastomer polyurethane, combined with a polyamide hot melt adhesive and with a solid plasticizer and tackifier resin;

PA.3 ["formulation (b)"]—thermoplastic elastomer polyurethane, combined with a solid plasticizer and tackifier resin;

PA.4 ["formulation (c)"]—thermoplastic elastomer polyurethane combined with a thermoplastic polyamide hot melt adhesive powder;

PES.2 and PES.3 ["formulation (d)"]—thermoplastic polyester polymer hot melt adhesive powder combined with thermoplastic elastomer polyurethane and with a solid plasticizer and tackifier resin; and PES.4 ["formulation (e)"] thermoplastic polyester hot melt adhesive, combined with thermoplastic elastomer polyurethane.

Heat transfer bonding conditions for this heat transfer adhesive layer testing were under the settings on an Insta 718 Bonder of Insta Graphic, with 15 inch by 15 inch platen, that are specified in Table D:

TABLE D

| Settings | Temp | Pressure | Dwell Time |
|---|---|---|---|
| L | 115 C. | 0.3 bar | 6 seconds |
| M | 125 C. | 0.4 bar | 9 seconds |
| H | 135 C. | 0.5 bar | 12 seconds |

The bond strengths of each tested heat transfer adhesive layer to polyester fabric were measured for each by Instron® T-peel test on fabric/adhesive/fabric layered test specimens bonded under the three types of heat transfer bonder test settings specified in Table D. These peel test data, which are set out in Table E, illustrate that combining polymer with solid plasticizer, tackifier resin component can achieve high fabric bonding strength at temperatures below 140° C., pressures below 1 Bar, and dwell times of less than 15 seconds.

TABLE E

| Specimen label | Maximum Load (N/in) | Average Load (N/in) |
|---|---|---|
| PA.2 L | 2.939 | 2.209 |
| PA.2 L | 2.962 | 2.368 |
| PA.3 L | 27.054 | 21.741 |
| PA.3 L | 27.241 | 22.315 |
| PA.4 L | 3.44 | 2.635 |
| PA.4 L | 3.749 | 2.669 |
| PA.2 M | 22.919 | 17.129 |
| PA.2 M | 23.268 | 18.27 |
| PA.3 M | 44.681 | 40.459 |
| PA.3 M | 48.086 | 41.512 |
| PA.4 M | 9.234 | 7.106 |
| PA.4 M | 10.361 | 7.913 |
| PA.2 H | 59.51 | 48.056 |
| PA.2 H | 58.363 | 49.137 |
| PA.3 H | 41.57 | 38.424 |

TABLE E-continued

| Specimen label | Maximum Load (N/in) | Average Load (N/in) |
|---|---|---|
| PA.3 H | 39.793 | 35.748 |
| PA.4 H | 23.949 | 17.704 |
| PA.4 H | 21.647 | 17.44 |
| PES.2 L | 7.924 | 6.194 |
| PES.2 L | 8.036 | 6.285 |
| PES.3 L | 6.096 | 4.641 |
| PES.3 L | 6.81 | 5.031 |
| PES.4 L | 5.594 | 4.314 |
| PES.4 L | 5.015 | 3.481 |
| PES.2 M | 32.284 | 19.324 |
| PES.2 M | 32.264 | 18.679 |
| PES.3 M | 31.32 | 24.138 |
| PES.3 M | 32.853 | 26.409 |
| PES.4 M | 11.281 | 7.597 |
| PES.4 M | 13.576 | 10.612 |
| PES.2 H | 66.865 | 59.856 |
| PES.2 H | 67.587 | 61.569 |
| PES.3 H | 42.053 | 37.719 |
| PES.3 H | 45.145 | 39.65 |
| PES.4 H | 44.707 | 33.703 |
| PES.4 H | 45.258 | 33.649 |

EXAMPLE 2

Screen printing evaluation testing was conducted using the Lenoir screen printing test, results being summarized in Table F. The Carrier for each sample was C-matte, a release-coated PET film from Hanse, and the Release was applicant's release print, designated as HD. Each sample incorporated the shaped release discussed herein. The Release Mesh in these data was 460 mesh, the mesh number used for the printing screen, and the Ink Mesh was 175 mesh, the mesh number used for screen printing the white inks, while the Adhesive Mesh was 92 mesh for all of the tests, ID #1, 2, 3 and 4. The white ink was either V4 white or Internal white, each a polyurethane-based screen print white ink.

Adhesive 2245-D was formed combining two components: (i) a polyester polymer powder with elastomeric polyester based polyurethane dispersion with (ii) a solid tackifies that was a melt flow/hot tack enhancing resin. Adhesive DK1-M was formed from a polyurethane powder and a polyurethane dispersion. These results show minimal bond mark (score 4.5 out of 5) of a visual or optical reading change on fabric surface around the transferred design after heat transfer. They also show good ink wetting, high printing resolution, and easy transfer by either hot peel or cold peel. The fabric onto which the label heat transfer testing was conducted was a fabric of polyester and spandex. The stretch test was passed in all instances, as was the hot water wash test (5 on a 1 to 5 scale) in this 60° C. hot water wash with subsequent drying for five repeats standard testing.

TABLE F

| ID # | Ink | Adhesive | Printing-Wetting Score (1 did not wet, 5 perfect wetting) | Printing-Registration (1 poor registration, 5 perfect registration) | Hot Peel (1-damages label or fabric, 5-very easy peel) | Cold Peel (1 damages label or fabric, 5 very easy peel) | Bond Mark | Stretch (pass/fail) | Wash Score (1-5) |
|---|---|---|---|---|---|---|---|---|---|
| 1 | V4 White | 2245-D | 5 | 5 | 5 | 4 | 4.5 | Pass | 5 |
| 2 | V4 White | DK1-M | 5 | 5 | 5 | 4 | 4.5 | Pass | 5 |
| 3 | Internal White | 2245-D | 5 | 5 | 5 | 4 | 4.5 | Pass | 5 |
| 4 | Internal White | DK1-M | 5 | 5 | 5 | 5 | 4.5 | Pass | 5 |

Concerning manufacture of label or transfer assemblies generally discussed herein, it is typical for each layer to be coated, such as being printed, on top of a previous layer in order to form sandwich-type structures as shown in the drawings hereof. Generally, these layers can be printed in reverse order, top to bottom. With further reference to the printing approach that is typically used in these instances, the layers are generated by printing inks that are subsequently cured and dried. Usually these inks are based on a water vehicle or a solvent vehicle that is dispersed or dissolved in one or several components such as polymers, additives, pigments, ink additives and the like. Examples of ink additives in this regard include humectants, rheology modifiers, surface tension modifiers, leveling agents, release agents, and so forth.

Example

Chemically Crosslinked Elastomeric Ink

| Ink Code | Ink Base | Chemical Cross-linker |
|---|---|---|
| W-2 | QL W-2 White* | None |
| W-2P | QL W-2 White | 1.1% PZ-33* |
| W-2V | QL W-2 White | 1.1% V-04K* |

*QL W-2 White is a mixture of —COOH functioned polyurethane dispersion in water with $TiO_2$ pigment slurry at about 4 parts to 1 part by weight ratio.
PZ-33 is an aziridine crosslinker.
V-04K is a carbodiimide crosslinker.

Figure 4:
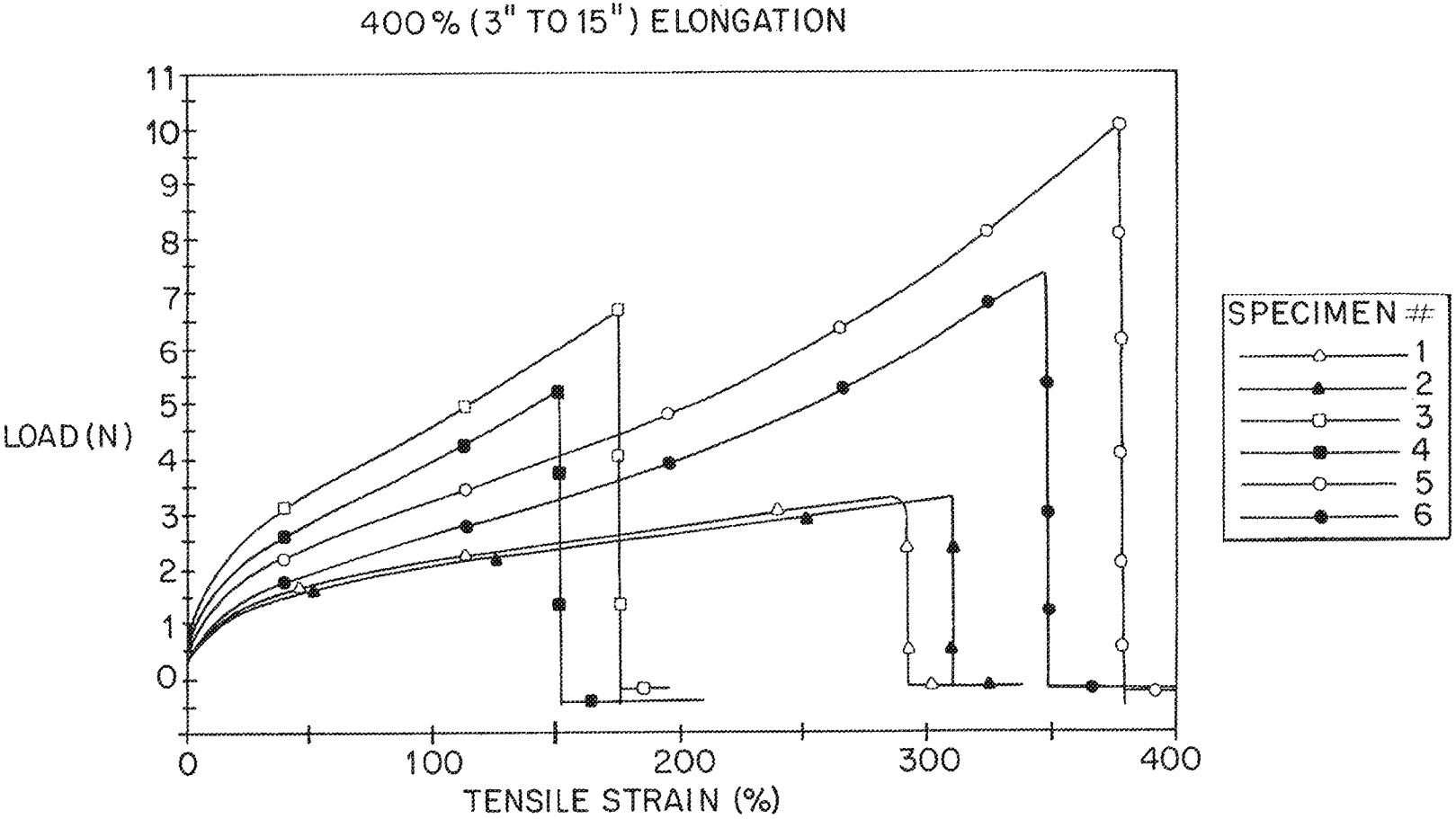
FIG. 4 is a plot of tensile strain versus load illustrating tensile elongation for six different specimens.

The effect of chemical crosslinking on the stretch performance of the elastomeric white ink is measured by Instron tensile elongation test and the results shown below in the table and plotted in FIG. 4. The ink layer thickness was about 1.5 mils in this test.

As shown, the tensile elongation of the elastomeric white ink was above 100% for all, and the carbodiimide crosslinker is capable of significantly enhancing tensile elongation.

| Specimen # | Specimen label | Load at Tensile Strength (N) | Tensile strain at Tensile Strength (%) |
|---|---|---|---|
| 1 | W-2 | 3.24 | 280.00 |
| 2 | W-2 | 3.22 | 301.67 |
| 3 | W-2P | 6.48 | 168.33 |
| 4 | W-2P | 5.04 | 144.67 |
| 5 | W-2V | 9.85 | 371.33 |
| 6 | W-2V | 7.18 | 341.00 |

Example

Effect of Transfer Enhancing Agent on the Bonding Strength of the Hot Melt Adhesive on Performance Fabric

| Adhesive Code | Transfer Enhancing Agent (5.5 wt % loading) | Phase | Adhesive Base |
|---|---|---|---|
| 2245-F | Ketjenflex 9S-M | Solid | 2245* |
| 2245-I | Uniplex 108 | Liquid | 2245 |
| 2245-J | Hercolyn D | Liquid | 2245 |
| 2245-K | Staybelite Ester 3 | Liquid | 2245 |
| 2245-L | Foralyn 5020F | Liquid | 2245 |
| 2245-M | Uniplex 214 | Liquid | 2245 |

*Adhesive 2245 Base is a mixture of PU elastomer and thermoplastic polyester at 45 parts to 55 parts by solid weight ratio.

The screen printed adhesive was heat transferred to polyspandex test fabric at 140 C and tested for adhesive to fabric bonding strength using T-peel test method by Instron after 5 cycles of 60 C hot water wash and 5 cycles of hot air drying. The T-peel strengths of the adhesives to the test fabric after wash are tabulated below.

| After 60 C. Hot Water Wash (5X Wash/5X Dry | Maximum Load (N/in) | Average Load (N/in) |
|---|---|---|
| 2245-F | 47.618 | 38.903 |
| 2245-F | 24.77 | 20.815 |
| 2245-I | 24.19 | 19.22 |
| 2245-I | 12.574 | 10.034 |
| 2245-J | 13.149 | 11.021 |
| 2245-J | 18.902 | 16.16 |
| 2245-K | 13.642 | 10.108 |
| 2245-K | 17.711 | 14.511 |
| 2245-L | 10.043 | 7.802 |
| 2245-L | 9.84 | 7.666 |
| 2245-M | 12.939 | 10.988 |
| 2245-M | 18.237 | 14.458 |

As shown, the solid state transfer enhancing agent provided higher bond strength after repeated hot water wash vs liquid phase ones.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A heat transfer label suitable for labeling performance fabrics with minimal transfer marking, comprising:

a. a support portion having a label carrier and a non-marking release layer; and b. a transfer portion, said transfer portion being positioned over said support portion release layer for transfer of the transfer portion from the support portion to a performance fabric under conditions of heat and pressure for a given dwell time, said transfer portion comprising:

i. a hot melt adhesive layer having a first surface and a second surface, the first surface being exposed to permit its direct contact with a performance fabric to be labeled, and ii. an ink design, said ink design is in contact and in conformity with the second surface of the hot melt adhesive layer, said ink design exhibits recoverable stretch properties; and c. said hot melt adhesive layer securely adheres the heat transfer label to performance fabrics at relatively low transfer temperature, pressure and dwell time while minimizing or substantially eliminating transfer marks on the performance fabrics.

2. The heat transfer label of claim 1, wherein the hot melt adhesive layer includes a thermoplastic or a thermoplastic elastomer based polymer, or a mixture of both, with a transfer enhancing agent.

3. The heat transfer label of claim 1, wherein the non-marking release of the label carrier is sized and shaped in substantial conformance with the size and shape of the ink design, thereby substantially eliminating ghost image generation by the release upon heat transfer application.

4. The heat transfer label of claim 1, wherein the release coating of the label carrier is sized and shaped in substantial conformance with the size and shape of the ink design and the hot melt adhesive layer, thereby substantially eliminating ghost image generation by the release coating upon heat transfer application.

5. The heat transfer label of claim 1, wherein the non-marking release is non-transferrable.

6. The heat transfer label of claim 1, wherein said release of the label carrier generally coincides with the size and shape of the label carrier.

7. The heat transfer label of claim 1, wherein said hot melt adhesive layer is selected from the group consisting of: a thermoplastic elastomer including thermoplastic polyurethane alone or in combination with polyacrylates; a thermoplastic copolymer that consists of a polyester or a polyamide component; and a transfer enhancing agent including solid or liquid plasticizers or tackifiers; and combinations thereof.

8. The transfer enhancing agent in claim 7 is a solid state plasticizer or tackifier, or combinations therefore.

9. The heat transfer label of claim 7, wherein the thermoplastic elastomer is a thermoplastic polyurethane of between about 15 and about 85 parts; the hot melt copolymer is a polyamide or polyester component of between about 0 and about 80 parts; the transfer enhancing agent is a solid state plasticizer of between about 2 and about 40 parts by weight of solids.

10. The heat transfer label of claim 1, wherein said hot melt adhesive layer securely adheres the heat transfer label to performance fabrics at a bonder application temperature of below about 140° C., bonder application pressure of below about 1 Bar and for a bonder application dwell time of less than 15 seconds.

11. The heat transfer label of claim 1, wherein the support portion consists of a film or paper substrate with a non-marking release on at least one substrate surface, and the non-marking release includes the following two types—(1) a non-transferrable release and (2) a shaped hot melt or hot split release.

12. The heat transfer label of claim 11 wherein the non-transferrable release of is a printable silicone.

13. The heat transfer label of claim 11 wherein the hot melt or hot split release is a polyolefin or a polyamide.

14. The heat transfer label of claim 13 wherein the polyolefin is polyethylene or polypropylene.

15. The heat transfer label of claim 11, wherein the support portion also has an anti-blocking release on the opposite side of the non-marking release.

16. The heat transfer label of claim 11 wherein, the carrier substrate is a heat stable plastic film or paper.

17. The heat transfer label of claim 16, wherein the release layer surface has a surface tension above about 25 dynes/cm.

18. The heat transfer label of claim 16 wherein the polyolefin is polyethylene or polypropylene.

19. The heat transfer label of claim 1, wherein the ink design layer comprises an ink layer having a maximum release force of between 0.1 and 2.0 N/in from the release layer.

20. The heat transfer label of claim 1, wherein the hot melt adhesive layer has a maximum release force of between 0.1 and 2.0 N/in from the release layer.

21. The heat transfer label of claim 1, wherein the ink design layer comprises an ink layer having a maximum release force of between 0.1 and 2.0 N/in from the release layer, and the hot melt adhesive layer has a maximum release force of between 0.1 and 2.0 N/in from the release layer.

22. A heat transfer label suitable for labeling performance fabrics with minimal transfer marking, comprising:

a. a support portion having a label carrier layer and a release layer; and b. a transfer portion, said transfer portion being positioned over said support portion release layer for transfer of the transfer portion from the support portion to a performance fabric under conditions of heat and pressure for a given dwell time, said transfer portion comprising:

i. a hot melt adhesive layer having a first surface and a second surface, the first surface being exposed to permit its direct contact with a performance fabric to be labeled, the hot melt adhesive layer includes a mixture of a thermoplastic polymer with a thermoplastic elastomer and a transfer enhancing agent, and ii. an ink design layer, said ink design layer is in contact and positioned in conformance with the second surface of the hot melt adhesive layer, said ink design layer exhibits recoverable stretch properties;

c. the release layer of the label carrier is sized and shaped in substantial conformance with the size and shape of an image delineated by said ink design layer, thereby substantially eliminating ghost image generation by the release coating upon heat transfer application; and d. said hot melt adhesive layer securely transfers the heat transfer label to performance fabrics at relatively low transfer temperature, pressure and dwell time while minimizing or substantially eliminating transfer marks on the performance fabrics.

23. The heat transfer label of claim 22, wherein the release coating of the label carrier is sized and shaped in substantial conformance with the size and shape of said hot melt adhesive layer, thereby contributing to substantially eliminating ghost image generation by the release coating upon heat transfer application.

24. The heat transfer label of claim 23, wherein the ink design layer comprises an ink layer having a release force of between 0.1 and 2.0 N/in from the release coating layer, and the hot melt adhesive layer has a release force of between 0.1 and 2.0 N/in from the release coating layer.

25. The heat transfer label of claim 22, wherein said hot melt adhesive layer is selected from the group consisting of: a thermoplastic elastomer including thermoplastic polyurethane alone or in combination with polyacrylate elastomers; a thermoplastic polymer including a polyester and a polyamide component; and a hot melt flow enhancing resin including solid or liquid plasticizers or tackifiers; and combinations thereof.

26. A heat transfer label suitable for labeling performance fabrics with minimal transfer marking, comprising:

a. a support portion having a label carrier layer and a release layer; and b. a transfer portion, said transfer portion being positioned over said support portion release coating layer for transfer of the transfer portion from the support portion to a performance fabric under conditions of heat and pressure for a given dwell time, said transfer portion comprising:

i. a hot melt adhesive layer having a first surface and a second surface, the first surface being exposed to permit its direct contact with a performance fabric to be labeled, the hot melt adhesive layer includes a thermoplastic elastomer, a thermoplastic polymer, and a plasticizer or tackifier resin; or combinations thereof, and ii. an ink design layer, said ink design layer having been in contact and in conformance with the second surface of the hot melt adhesive layer, said ink design layer exhibits recoverable stretch properties;

c. the release coating of the label carrier is sized and shaped in substantial conformance with the size and shape of an image delineated by said ink design layer, thereby substantially eliminating ghost image generation by the release coating upon heat transfer application; and d. said hot melt adhesive layer securely transfers the heat transfer label to performance fabrics at transfer temperature of below about 140° C., a pressure of below about 1 Bar, and dwell time of less than 15 seconds, while substantially eliminating transfer marks on the performance fabrics.

* * * * *